United States Patent [19]

Centers

[11] Patent Number: 4,828,729

[45] Date of Patent: May 9, 1989

[54] MOLYBDENUM DISULFIDE - MOLYBDENUM OXIDE LUBRICANTS

[75] Inventor: Phillip W. Centers, Dayton, Ohio

[73] Assignee: The United States of America as represented by the Secretary of the Air Force, Washington, D.C.

[21] Appl. No.: 181,135

[22] Filed: Apr. 13, 1988

[51] Int. Cl.[4] ..... C10M 103/06; C10M 125/10

[52] U.S. Cl. ..... 252/25

[58] Field of Search ..... 252/25

[56] References Cited

U.S. PATENT DOCUMENTS

| | | | |
|---|---|---|---|
| 3,223,626 | 12/1965 | Murphy et al. | 252/25 |
| 3,314,885 | 4/1967 | Murphy | 252/25 |
| 3,622,512 | 11/1971 | Christian | 252/21 |
| 3,935,114 | 1/1976 | Donaho | 252/18 |
| 4,406,800 | 9/1983 | Christian | 252/28 |

FOREIGN PATENT DOCUMENTS

| | | | |
|---|---|---|---|
| 0215494 | 12/1983 | Japan | 252/25 |

OTHER PUBLICATIONS

Charles E. Vest, Development and Uses of an In Situ $MoS_2$ Solid Film Lubricant, 1969 International Electronic Circuit Packaging Symposium, (Aug. 20–21, 1969).

Tribological Performance of $MoS_2$ Compacts Containing $MoO_3$, $Sb_2O_3$ or $MoO_3$ and $Sb_2O_3$, Wear, vol. 122, No. 1, pp. 97–102, Feb. 15, 1988.

The Role of Oxide and Sulfide Additions in Solid Lubricant Compacts, ASLE Annual Meeting, Anaheim, Calif., May 1987, ASLE Preprint 87-AM-7A-2.

P. D. Fleischauer and R. Bauer, "The Influence of Surface Chemistry on $MoS_2$ Transfer Film Formation", ASLE Annual Meeting, Canada, May 86.

P. W. Centers, "The Role of Bulk Additions in Solid Lubricant Compacts", U.S. Air Force Technical Report AFWAL-TR-2125, cover date; Apr. 87, pub. Jul. 87.

*Primary Examiner*—William R. Dixon, Jr.
*Assistant Examiner*—Jerry D. Johnson
*Attorney, Agent, or Firm*—C. E. Bricker; Donald J. Singer

[57] ABSTRACT

A solid lubricating material consisting essentially of an intimate mixture of about 15 to 50 mole percent molybdenum trioxide, balance molybdenum disulfide. This material is particularly useful under extreme environmental conditions such as very high temperature or vacuum. The material may be used in powder form, compacted into a pellet or other desired shape, incorporated into a grease composition or incorporated into a resin-bonded solid film lubricant.

6 Claims, No Drawings

MOLYBDENUM DISULFIDE - MOLYBDENUM OXIDE LUBRICANTS

RIGHTS OF THE GOVERNMENT

The invention described herein may be manufactured and used by or for the Government of the United States for all governmental purposes without the payment of any royalty.

BACKGROUND OF THE INVENTION

This invention relates to lubricating materials.

Wear, defined as the removal of material from a solid surface, may be categorized as adhesive, abrasive, corrosive, surface fracture, erosive and fretting. Adhesive wear is thought to be most common, followed by abrasive wear.

Adhesive wear originates in the attractive atomic forces as two surfaces are brought together. Adhesion may result in material removal from either surface, depending upon material and environmental factors. Quantitatively, for adhesive wear, wear is directly proportional to load and sliding distance, and inversely proportional to the worn surface hardness.

Abrasive wear occurs when a hard surface slides across a softer surface creating grooves with a loss of material. Abrasive wear can be classified as two or three-body wear. Two-body occurs when a hard, rough surface interacts with another surface, while three-body wear occurs when hard, abrasive particles interact at the sliding interface of two other materials.

Lubricants are used to prevent contact of parts in relative motion and thereby reduce friction and wear. The most effective method of lubrication is to provide a hydrodynamic film between two surfaces, in which a fluid film is drawn into the contact area between two sliding surfaces. The coefficient of friction can be very low and with good design and maintenance, component lives can be very long.

Under high load conditions, the lubrication regime is elastohydrodynamic, in which lubrication is influenced by the elastic properties of the substrates. Under very high load, surface asperities come into contact and boundary lubrication begins. Boundary lubrication occurs frequently in high load sliding applications. For example, the hypoids used in automotive rear-axle transmissions operate under such severe conditions of load and sliding speed, with resulting high temperature and pressure, that ordinary lubricants cannot provide complete protection against metal contact. For such applications, extreme pressure additives are employed which provide a source of renewable surface boundary lubricant. Such additives react at hot spots on the surface to form a solid lubricating surface.

For most lubrication applications, fluids are adequate and perform remarkably well especially when formulated with additives, e.g., anti-oxidants, dispersants, and/or viscosity improvers to enable their use over a wide temperature range. However, applications under extreme environmental conditions, such as very high temperature or vacuum, preclude the use of fluid lubricants. Under such conditions, a solid lubricant may be employed in place of a liquid lubricant.

Solid lubricants are any solid material which may be used between two surfaces to provide protection from damage during relative movement to reduce friction and wear. Some advantages of solid lubricants include good stability at extreme temperatures and in chemically active environments, high load lubricating capacity and light weight. Some disadvantages include higher coefficient of friction as compared to hydrodynamic lubrication, solid sliding contact wear, finite lifetime and lack of cooling capability.

Two of the most useful solid lubricants are graphite and molybdenum disulfide. Both of these materials lubricate by shearing interlaminarly with small forces while carrying high normal loads. It has been observed that adsorbed water and gases improve the lubrication performance of graphite, while such adsorbed species are not required for molybdenum disulfide lubrication. Therefore, at higher temperatures, oxidatively stable graphite loses adsorbed species and, thus, much of its lubricating ability. In contrast, molybdenum disulfide lubricates effectively to relatively high temperatures without such adsorbed species, but oxidizes at lower temperatures than graphite.

Antimony trioxide is known to enhance the tribological performance of molybdenum disulfide in air from ambient temperature to about 315° C. $MoS_2$ begins to oxidize to $MoO_3$ at about 315° C. Between about 315° C. and 370° C., oxidation is rapid. It has long been thought that oxidation of $MoS_2$ to $MoO_3$ is to be avoided. Various hypotheses have been offered for the beneficial effect of $Sb_2O_3$ addition to $MoS_2$, that $Sb_2O_3$ oxidizes sacrificially to retard the oxidation of $MoS_2$, that $Sb_2O_3$ forms an unharmful or even beneficial eutectic with $MoO_3$, or that $Sb_2O_3$ has some other undefined antioxidant role. The consensus has been that any quantity of $MoO_3$ in $MoS_2$ is to be avoided, if possible.

Recent work indicates some change in attitude; that $MoO_3$ may not be detrimental to the lubricating property of $MoS_2$. Hitachi, Japanese Pat. No. 0215494 disclose that a solid lubricating material made of $MoS_2$ has oxidation temperature increased by the addition of 0.1 to 10 weight percent of an acidic substance selected from the group consisting of PbO, $VO_2$, PbS, $MoO_3$, $BiO_2$, Mn oxide, Cu fluoride, W, B, P, Sb, Bi, Co or C. Fleischauer, P.D. and Bauer, R, "The Influence of Surface Chemistry on $MoS_2$, Transfer Film Formation", ASLE Preprint No. 86-AM-5G-Z, observe that rf sputtered films of $MoS_2$ whose surface layers have from 30 to 40 percent oxidized molybdenum have the longest wear lifetimes. The authors propose that oxidation of some portion of the $MoS_2$ in the interface region between the film and the substrate results in longer wear lifetimes because such oxidation promotes good adhesion of the transfer lubricant film. They envision a graded interface that consists of a transition from metal to mixed oxides and sulfides to nominally pure $MoS_2$, with the mixed region being only a few atomic layers thick.

I have discovered that the bulk addition of $MoO_3$ to $MoS_2$ in amounts of about 15 to 50 mole percent $MoO_3$ improves the tribological performance of $MoS_2$.

Accordingly, it is an object of the present invention to provide an improved solid lubricant.

Other objects, aspects and advantages of the present invention will be apparent to those skilled in the art.

DESCRIPTION OF THE INVENTION

In accordance with the present invention, there is provided a solid lubricating material consisting essentially of an intimate mixture of about 15 to 50 mole percent molybdenum trioxide, balance molybdenum disulfide.

In one embodiment of the invention, the solid lubricating material is a dry mixture of about 15 to 50 mole percent, preferably about 25 to 40 mole percent of $MoO_3$, balance $MoS_2$.

The particulate $MoS_2$ should comprise fine particles having average diameter less than 10 microns. The $MoS_2$ may be classified, containing relatively uniform sizes, or it may contain a range of particle sizes, some fine and some coarse. A satisfactory commercial grade of $MoS_2$ is technical grade $MoS_2$ (98.2 wt. % $MoS_2$) available from Bemol, Inc., Elmwood, Ct. The $MoO_3$ should comprise particles having an average diameter less than about 30 microns. A suitable commercial grade of $MoO_3$ (less than 30 microns, 99+% pure on a metals basis) is available from Alfa, Danvers, MA.

The dry powder mixture is used in the same manner as known dry lubricating powder mixtures. The lubricating mixture of this invention is particularly suitable for applications which require lubrication under extreme environmental conditions such as very high temperature or vacuum. This mixture may be employed at operating temperatures up to about 600° F. (325° C.) in an oxidizing atmosphere or up to about 840° F. (450° C.) in an inert or non-oxidizing atmosphere.

In another embodiment of the present invention, the aforesaid mixture of molybdenum disulfide and molybdenum trioxide is compacted into a desired shape. For example, the powder mixture may be compacted into pellets, or into the interstices of a suitable honeycomb structure for use in lubricating sliding bearing surfaces, or into the separator structure of a ball bearing assembly for lubricating the rolling balls. The powder mixture can be compacted by applying a pressure of about 2 to 8 Ksi.

In yet another embodiment of the present invention, the aforesaid lubricating powder mixture is incorporated into a grease composition. The lubricating powder mixture may be incorporated into any known grease composition. The aforesaid powder mixture is particularly well suited for use in grease compositions intended for use under extreme environmental conditions. Several base fluids are known for compounding into extreme condition grease compositions including, but not limited to polyol alphatic esters, fluorinated polysiloxanes, polyol aliphatic ester/fluorinated polysiloxane blends and the like. Suitable thickeners for such grease compositions include montmorillonite clay, smectite clay and the like. A typical grease composition may contain about 70 to 90 weight percent of base fluid, about 10 to 30 weight percent of thickener and about 1 to 6 weight percent of the previously described mixture of molybdenum disulfide and molybdenum trioxide.

In a further embodiment of the present invention, the aforesaid lubricating powder mixture is incorporated into a resin-bonded solid film lubricant. The lubricating powder mixture of the present invention may be incorporated into any known resin-bonded solid film lubricant, substituting the instant powder mixture for the dry lubricant(s) previously used. A suitable solid film lubricant disclosed by Murphy, U.S. Pat. No. 3,314,885, comprises about 20 to 45 weight percent of an epoxy-phenolic resin system, 4 to 18 weight percent antimony trioxide, 10 to 24 weight percent molybdenum disulfide, 2 to 9 weight percent dibasic lead phosphite, 0.2 to 1.7 weight percent modified magnesium bentonite and 20 to 45 weight percent p-dioxane. This recipe may be used, substituting about 14 to 42 weight percent of the lubricating powder mixture of the present invention for the combined total of 14 to 42 weight percent mixture of antimony trioxide and molybdenum disulfide disclosed therein.

The following example illustrates the invention:

EXAMPLE

High purity $MoO_3$ and $Sb_2O_3$ were individually ground mechanically then sieved through a 30 micron nickel screen. The oxides were weighed and thoroughly mixed with technical grade $MoS_2$.

Wear compacts were prepared using a laboratory press with a 6.35 mm (diameter) cylindrical die under 172 MPa (25 ksi) load. One half of the die served as a compact holder which was mounted in a lathe so that a conical tip could be formed with a receding 21.8° angle to facilitate microscopic examination of cone diameter for calculating wear volume.

Single pellets were mounted in a Midwest Research Institute Mark VB test machine (Midwest Research Institute, Kansas City, Missouri) for wear evaluation. This machine is a pin-on-disk test machine which permits mounting of a wear compact on a counterbalanced arm. The arm may be loaded with weights directly over the compact. The arm is mounted by two leaf springs that resist the friction force. A portion of the arm is the core of a linear variable differential transformer (LVDT). Outputs of the LVTD varies as frictional forces change. The test area of the apparatus is mounted underneath a bell jar for countrol of temperature and pressure.

The flat wear substrate was type 302 stainless steel shim stock (0.05 mm thick) rigidly attached to a massive heated support. The counter-balanced arm was loaded with 100 g. The system was purged with dry air and the wear surface was heated to 315°±5° C. Under test, the support rotated at 500±10 rpm; each compact described a circular wear track of 23.81 mm. diameter on the substrate. Each compact was worn for 1000 seconds. The equivalent sliding distance was 180.5 m.

The following table presents wear volume and coefficient of friction data for compacts of $MoS_2$ (above), 75 mole % $MoS_2$+25 mole % $MoO_3$ and 75 mole % $MoS_2$+25 mole % $Sb_2O_3$. The wear volume represents the volume of compact worn away over the test period.

TABLE

| Compact | Wear Volume ($mm^3$) (mean and standard deviation) | Coefficient of Friction (mean 0.5 and 15 mm values) |
|---|---|---|
| $MoS_2$ | 0.158 ± 0.033 | 0.07–0.11 |
| $MoS_2$ + $Sb_2O_3$ | 0.097 ± 0.017 | 0.10–0.15 |
| $MoS_2$ + $MoO_3$ | 0.044 ± 0.010 | 0.12–0.16 |

The above data indicates that wear compacts containing $MoO_3$ had only about 25% of the wear volume of $MoS_2$ alone. The $MoS_2$-$Sb_2O_3$ compacts were als be seen that the $MoS_2$-$MoO_3$ compacts had only about half the wear volume of the $MoS_2$-$Sb_2O_3$ compacts. The coefficients of friction of the oxide-containing compacts are higher than the $MoS_2$ compacts; however, the $MoS_2$-$MoO_3$ and $MoS_2$-$Sb_2O_3$ coefficients remained comparable over the test period.

I claim:

1. A solid lubricating material consisting essentially of an intimate mixture of about 15 to 50 mole percent molybdenum trioxide, balance molybdenum disulfide.

2. The solid lubricating material of claim 1 wherein the quantity of molybdenum trioxide is about 25 to 40 mole percent.

3. The material of claim 1 in powder form.

4. The material of claim 1 in compacted form.

5. A grease composition comprising about 1 to 6 weight percent of a solid lubricating material consisting essentially of an intimate mixture of about 15 to 50 mole percent molybdenum trioxide, balance molybdenum disulfide.

6. A resin-bonded solid film lubricant comprising about 14 to 42 weight percent of an intimate mixture of about 15 to 50 mole percent molybdenum trioxide, balance molybdenum disulfide.

* * * * *

UNITED STATES PATENT AND TRADEMARK OFFICE

CERTIFICATE OF CORRECTION

PATENT NO. : 4,828,729

DATED : May 9, 1989

INVENTOR(S) : Phillip W. Centers

It is certified that error appears in the above-identified patent and that said Letters Patent is hereby corrected as shown below:

Col 4, line 58, change "als" to --also superior to $MoS_2$ alone; however, it can--.

Signed and Sealed this

Twenty-fifth Day of September, 1990

*Attest:*

HARRY F. MANBECK, JR.

*Attesting Officer*

*Commissioner of Patents and Trademarks*